US005787972A

United States Patent [19]

Beamer et al.

[11] Patent Number: 5,787,972

[45] Date of Patent: Aug. 4, 1998

[54] COMPRESSION TOLERANT LOUVERED HEAT EXCHANGER FIN

[75] Inventors: Henry Earl Beamer, Middleport; Duane Victor Beales, Gasport, both of N.Y.

[73] Assignee: General Motors Corporation, Detroit, Mich.

[21] Appl. No.: 916,607

[22] Filed: Aug. 22, 1997

[51] Int. Cl.[6] ..... F28F 1/22

[52] U.S. Cl. ..... 165/152; 165/DIG. 487

[58] Field of Search ..... 165/152, 153, 165/183, DIG. 478, DIG. 505

[56] References Cited

U.S. PATENT DOCUMENTS

| | | | |
|---|---|---|---|
| 3,003,749 | 10/1961 | Morse | 257/130 |
| 3,250,325 | 5/1966 | Rhodes et al. | 165/153 |
| 3,265,127 | 8/1966 | Nickol et al. | 165/152 |
| 4,328,861 | 5/1982 | Cheong et al. | 165/151 |
| 4,593,756 | 6/1986 | Itoh et al. | 165/151 |
| 4,615,384 | 10/1986 | Shimada et al. | 165/152 |
| 5,035,052 | 7/1991 | Suzuki et al. | 29/890.046 |
| 5,176,020 | 1/1993 | Maruo et al. | 72/186 |
| 5,289,874 | 3/1994 | Kadle et al. | 165/152 |
| 5,361,829 | 11/1994 | Kreutzer et al. | 165/152 |
| 5,390,731 | 2/1995 | Selm et al. | 165/152 |

*Primary Examiner*—Allen J. Flanigan
*Attorney, Agent, or Firm*—Patrick M. Griffin

[57] ABSTRACT

A heat exchanger core (20) has tubes (22) which are stiffer and more resistant to core assembly compression at the elongated tube edges (24). Corrugated cooling fins (46) stacked between the tubes (22) have fin walls (48) that cross the stiffer tube edges (24) and a series of vane like louvers (54, 56) that are regularly spaced along the fin walls (48). The outboard louvers (56) on both sides of each fin wall (48) are strategically shortened, as compared to the longer inboard louvers (54) so that the fin walls (48) will be stiffened less, and less subject to buckling when the core (20) is stacked during assembly.

3 Claims, 6 Drawing Sheets

COMPRESSION TOLERANT LOUVERED HEAT EXCHANGER FIN

TECHNICAL FIELD

This invention relates to heat exchangers in general, and specifically to a corrugated, louvered fin therefor that is less prone to buckling when compressed between the parallel tube pairs of the heat exchanger.

BACKGROUND OF THE INVENTION

The present invention can be better understood after a detailed description of the current state of the art, and the drawings representing it, in which:

FIG. 1 is a perspective view of a pair of heat exchanger tubes with a corrugated fin compressed between them;

FIG. 2 is an end view of the outer edge of a single fin, viewed generally in the direction of air flow;

FIG. 3 is a perspective view of a corrugated cooling fin with a series of standard length louvers cut into the fin walls;

FIG. 4 is an end view of the fin shown in FIG. 3;

FIG. 5 is a perspective view of a newer corrugated fin generally similar to the fin shown in FIG. 3, but with significantly greater end to end louver length, as a proportion of fin wall width;

FIG. 6 is an end view of the fin shown in FIG. 5;

FIG. 7 is a side view of the fin shown in FIG. 5, shown in relation to the width of a single tube;

FIG. 8 is a view showing the buckling failure mode of the fin shown in FIG. 5 when compressed between a pair of parallel tubes;

FIG. 9 is an end view of the failed fin shown in FIG. 8.

Referring first to FIGS. 1 and 2, a typical parallel flow heat exchanger core, indicated generally at 20, has a series of parallel, generally flat tubes, two of which are indicated generally at 22. Tubes 20 are typically elongated in the direction Y, but only a short section thereof is shown for ease of illustration. The tubes 22 are spaced apart by a given surface to surface spacing S, in the completed unit. Each tube 22 is hollow and generally rectangular in cross section, with thin, upper and lower walls held together only by their parallel, outer edges 24, separated by a given tube width X. As a consequence, the tube 22 is naturally stiffer and more resistant to being compressed in a direction perpendicular to the plane of the tube walls, in defined regions running generally along the outer edges 24. Further inboard of the outer edges, the tubes 22 are more flexible and less resistant to compression. This is significant, because heat exchanger cores like 20 are generally assembled by stacking the tubes 22 together at an initial spacing slightly greater than S, and then pushed together to the final spacing S. Stacked between each pair of parallel tubes 22 is a corrugated cooling fin, indicated generally at 26. Fin 26 is a unitary piece, folded from thin metal sheet stock, but has several distinct features, including edges, folds and surfaces, the characteristics and dimensions which it is useful to describe in detail. Each fin 26 is comprised of a series of thin, flat fin walls 28, joined to one another at alternating folds or crests 30. The crests 30 are oriented generally perpendicular to the tube length L. Air flows between the fin walls 28 and the bordering surfaces of the tubes 22, in a direction generally along the crests 30. Each fin wall 28 is generally rectangular, with a given width W, measured from crest 30 to crest 30 along the surface of fin wall 28. Almost always, each fin wall 28 also contains a double series of so called louvers, arranged in a leading pattern A and trailing pattern B, relative to the direction of air flow. More detail on these is given below. The length of each wall 28, measured between the outer edges 32 thereof and perpendicular to the width W, is equivalent to the length of a crest 30, and indicated at L. Generally, L may be made slightly greater than the tube width X, for reasons described further below. The fin 26 also has what may be referred to as a free state, uncompressed height H, measured perpendicularly between planes touching the crests 30 on each side of fin 26. In the limiting case, where the fin walls 28 are corrugated parallel to one another, H would be equal to W. Generally, however, the fin walls 28 diverge in a definite V shaped configuration, so that H is less than W. In either event, the free state dimension H is generally set to be slightly larger than the predetermined final spacing S between adjacent pairs of tubes 22. This is deliberate, and assures that, when the tubes 22 are pushed closer together to their nominal final spacing S, each fin 26 will be put in compression, with each fin crest 30 assured of tight contact with a respective surface of a tube 22. Ultimately, the fin crests 30 are brazed to the surfaces of the tubes 22, creating a complete, solid heat exchanger core.

Referring next to FIGS. 3 and 4, more detail on fin 26 is illustrated. Each fin wall 28, as noted, has a double series of louvers 34. The louvers in both patterns A and B are long, narrow, rectangular vanes, regularly spaced along the length of the crests 30. Each louver 34 is bent straight out of the plane of fin wall 28, thereby moving material symmetrically to either side thereof, and forming a slight angle relative to the plane of fin wall 28. That angle reverses from the leading pattern A to the trailing pattern B, but, otherwise, the louver shape is identical between the two patterns A and B. The louvers 34 are designed to break up the air flow through the fin 26, preventing it from becoming laminar, and thereby improving thermal performance. As best seen in FIG. 4, each fin crest 30, rather than being a sharp V point, is curved or radiused. Each louver 34 runs generally parallel to the width W of a fin wall 28, although its end to end length is less than W, leaving a differential relative to the peaks of the crests 30, indicated at D1. As a consequence, the louvers 34 do not intrude up toward the peaks of the crests 30 far enough to significantly affect their flexibility. This radiused shape not only increases surface contact with the surface of the tubes 22, but creates thin, converging "pockets" in which melted braze material can be drawn to create solid braze seams. The radiused shape also provides an advantage during the core assembly process, as described farther below.

Referring next to FIGS. 5 and 6, an embodiment of a recent variant of the fin 26 just described is indicated generally at 36. Fin 36 appears very similar to fin 26, but, while not old enough to constitute prior art in the legal sense relative to the subject invention, does encompass a structural difference from the typical fin 26 that is very relevant to the subject invention. As noted above, the radiused crests 30 have a significant spacing differential D1 relative to the ends of the louvers 34. Fin 36, however, is produced according to a different method which causes the fin walls 38 to be joined at crests 40 that are sharper in radius and less flexible. As seen in FIG. 5, the louvers 44 are lanced out of the planes of the fin walls 38 at a skewed angle, rather than square to the fin walls 38, which allows for a longer end to end length. There is, therefore, a significantly smaller differential D2 between the ends of the longer louvers 44 and the peaks of the crests 40. This has marked benefits in the thermal performance of the fin 36 as compared to fin 26. There is, however, a potential drawback in the core assembly process, described next.

Referring next to FIG. 7, when the core 20 is assembled, the fins 36 are stacked between the tubes 22. Because the length of the fin wall crests 30 is slightly greater than the tube width X, as noted above, the fin wall outer edges 42 overhang the tube outer edges 24 slightly. This overhang increases thermal performance, by putting more fin wall 38 area in contact with the cooling air stream. The overhang also assures that the crests 30 cross and overlap with the tube outer edges 24, and thereby places a small number of the outermost louvers 44 in line with the defined regions near the tube outer edges 24, indicated at O, where the tube 22 is stiffest. That is exactly the area where, when the core 20 is compressed, the crests, fin walls, and louvers are subject to buckling failure. This is also be true for the conventional length louver fin 26, which has a comparable crest length L. However, with the conventional fin 26, in that vulnerable area, the crests 30 can flex and flatten out slightly, compensating for the H to S differential referred to above. By bowing down and flattening out, the crests 30 absorb that compression like a spring, isolating the fin walls 28 from the full effect thereof. The fin walls 28 and their louvers 34 are therefor generally prevented from collapsing or buckling out of plane, preserving their original shape and relative orientation. With fin 36, the louvers 44 intrude farther upward toward the peaks of the crests 40, which are thereby stiffened, the longer louvers 44 acting, in effect, like stiffening corrugations. As a consequence, the crests 40, especially the outboard, leading and trailing portions of their length, are less able to flex and absorb over compression. Likewise, those louvers 44 nearest the fin wall outer edges 42 and in line with the tube edges 24, some two or three, are more subject to buckling and deformation. This added vulnerability to buckling would not necessarily show up in every core assembled, or even in every fin within a given core, given the inevitable manufacturing and assembly tolerance variations from core to core.

Referring next to FIGS. 8 and 9, a test was done to demonstrate the tendency of fin 36 to buckle, by deliberately over compressing a number of tubes and fins, that is, to a compression level over and above the normal assembly compression created by the H to S differential referred to above. A partial stack of four tubes 22 with three fins 36, representative of a section of a complete core 20, was held in a fixture and compressed past the normal point, thereby assuring and causing compressive fin failure. The result is illustrated in FIGS. 8 and 9. Those louvers 44 nearest the tube outer edges 24 have buckled out of plane, because that portion of the length of the fin crests 40 with which they were aligned was not as able to flatten and bow down to absorb the over compression. This is confirmed in the end view, FIG. 9, where it can be seen that the portion of the fin crests 40 nearest the fin wall outer edges 42 has remained sharp and unflattened. While this is a result that would likely occur, in actual assembly practice, only in those cores that were at the upper limits of the H minus S differential, it would still be desirable to avoid the potential for crush failure, if possible, and especially if it could be done in a way that did not adversely effect overall thermal performance to a significant degree.

SUMMARY OF THE INVENTION

A corrugated cooling fin with louvers modified in accordance with the present invention is characterized in general by the features specified in claim 1.

More specifically, a preferred embodiment of a cooling fin made according to the invention is modified so that a plurality of outboard louvers, that is, those louvers nearest the outer edges of the fin walls, are deliberately shortened relative to the remaining, inboard louvers, which are left full length. Consequently, an interior portion of the length of each fin crest is stiffened by the presence of the full length inboard louvers, as described above, while an outer portion of the crest length, nearest the fin wall outer edges, is relatively more flexible. When the fins are stacked between the tube pairs, the longer inboard louvers and less flexible, interior portion of the crest length are both aligned with the more flexible, inboard portion of the heat exchanger core tubes. Conversely, the shorter, outboard louvers and the more flexible, outer portion of the crest length are both aligned with the stiffer tube edges.

When the core is compressed after stacking, the more flexible outer portion of the fin crest length is able to flex and bow to absorb the compressive forces that could otherwise buckle the fin walls. Fin crush resistance is achieved that is comparable to the older, short louver fin designs. In the event of over compression, any buckling will be substantially limited to and absorbed by the shorter, outboard louvers, isolating and protecting the remainder of the fin walls. In practice, the shorter, outboard louvers, decrease thermal performance slightly relative to those fins with all louvers lengthened, but without as great an increase in air pressure drop across the core. Therefore, the overall fin performance, in terms of both thermal operation and crush resistance, is improved as compared to a fin with all the louvers lengthened.

BRIEF DESCRIPTION OF THE DRAWINGS

These and other features of the invention will appear from the following written description, and from the drawings, in which.

DESCRIPTION OF THE PREFERRED EMBODIMENT

Figure 10:
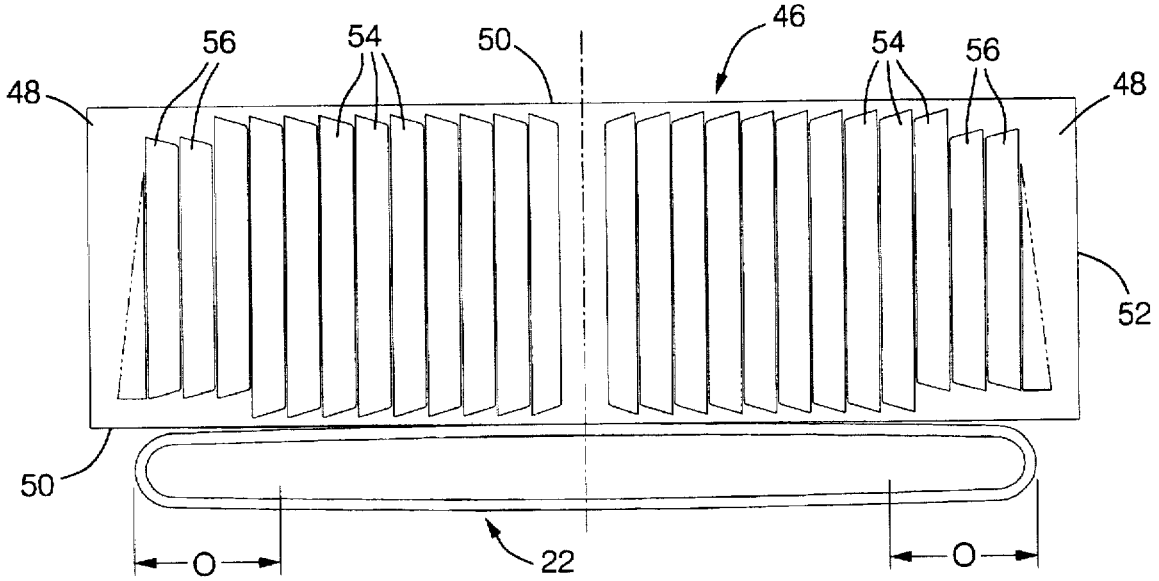
FIG. 10 is a side view of a preferred embodiment of a corrugated cooling fin made according to the invention, shown aligned with a tube 22 as it would be both in the tube stacker and in the completed core.
Figure 11:
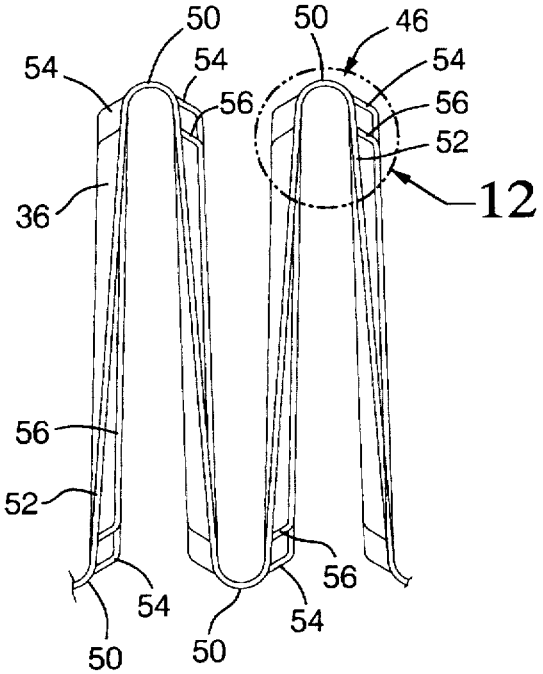
FIG. 11 is an end view of the fin shown in FIG. 10.
Figure 12:
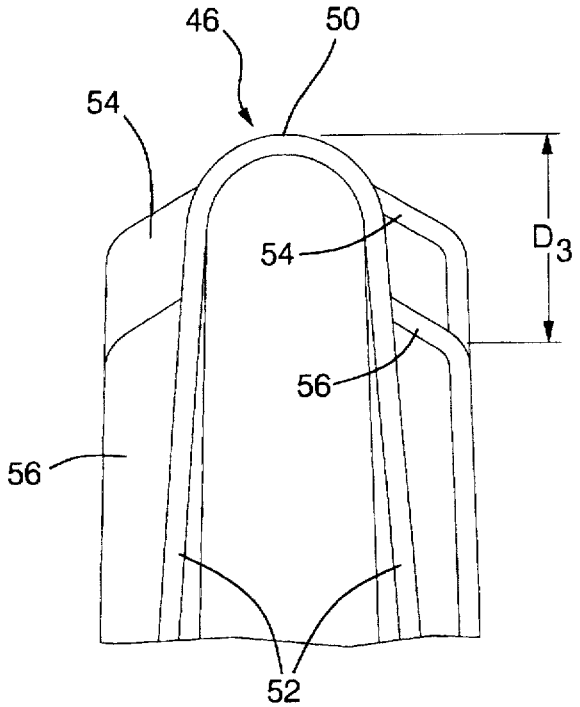
FIG. 12 is an enlargement of the circled portion of FIG. 11.

Referring first to FIGS. 10 through 12, a corrugated cooling fin made according to the invention is indicated generally at 46, in general, very similar to fin 36 as described above, both as to shape and basic dimensions. Specifically, fin 46 has the same series of fin walls 48, joined at crests 50, with a comparable length L measured between the outer edges 52, a comparable width W, and a comparable height H. The crest length L bears the same relationship to the tube width X, so it is assured that the outboard portions of the crests 50 do overlap and cross the tubes edges 24. Also, the fin height H bears the same relationship to the nominal tube spacing S, so that the fin walls 48 are put under a comparable compression in the assembly stacker. The inboard louvers 54, that is, all but the outermost few of the leading and trailing louvers, are comparable in length to the long louvers 44 of fin 36, comprising a comparable percentage of the fin wall width W. The outboard two louvers, however, indicated at 56, are shorter in length, and leave a larger differential D3 relative to the peak of the crest 50. The outboard louvers 56 could be comparable, in terms of end to end to end length as a percentage of fin wall width W, to the shorter louvers 34 in conventional fin 26. The number of outboard louvers 56 so shortened would be enough to overlap and coincide with that area of the tube 22, indicated at O, that is substantially stiffened by the presence or proximity of the stiffer tube edge 24. Consequently, an outer portion of the length of the crest 50, somewhat greater in length than the width of the area O of tube 22 just described, would remain significantly more flexible than the inner portion of the crest 50. The production process for fin 46, as compared to 36, would differ only in that the wheels that cut the louvers would be altered accordingly. This, as will be understood by those skilled in the art, is not a change in the production process at all, and only a minor, one time change to the tooling. The end result, however, is quite significant.

Figure 1:
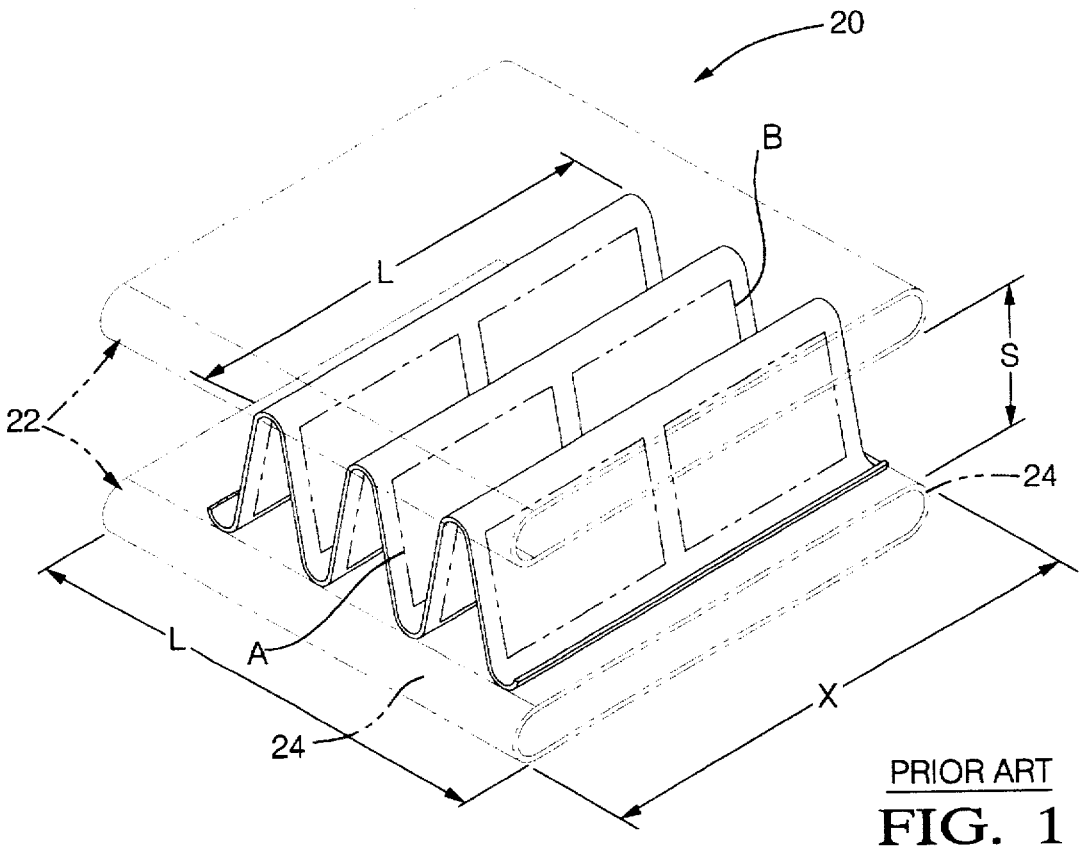
PRIOR ART FIG. 1
Figure 2:
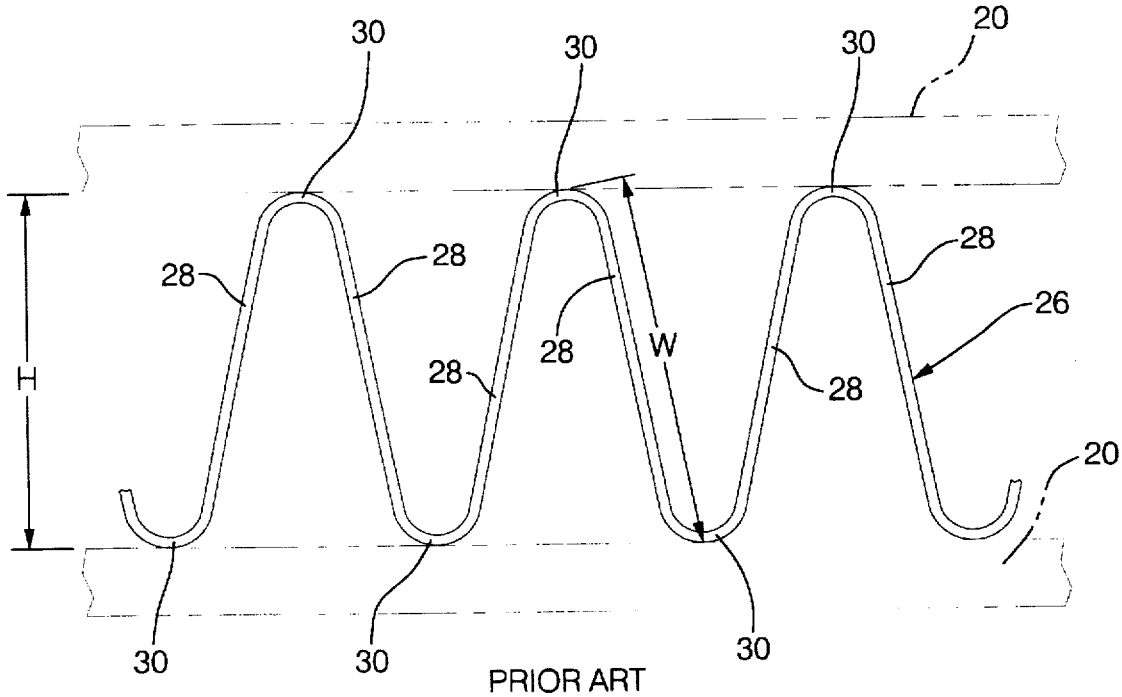
PRIOR ART FIG. 2
Figure 3:
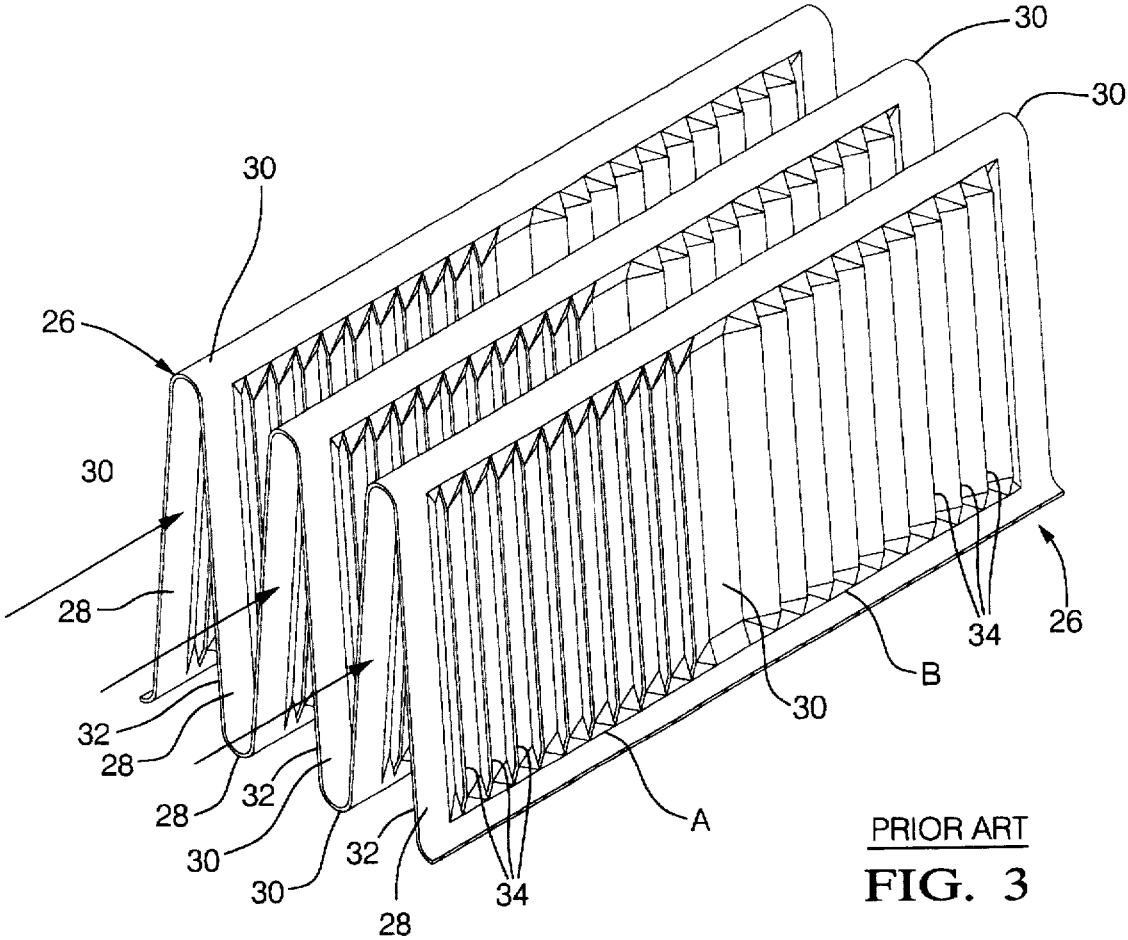
PRIOR ART FIG. 3
Figure 4:
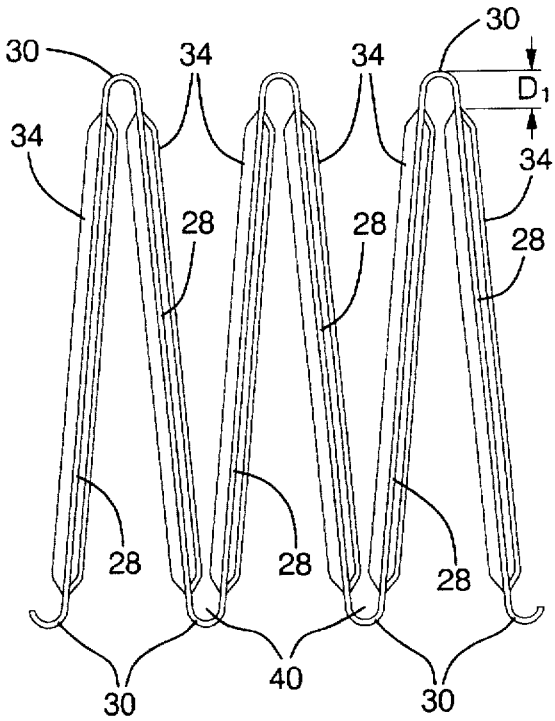
PRIOR ART FIG. 4
Figure 5:
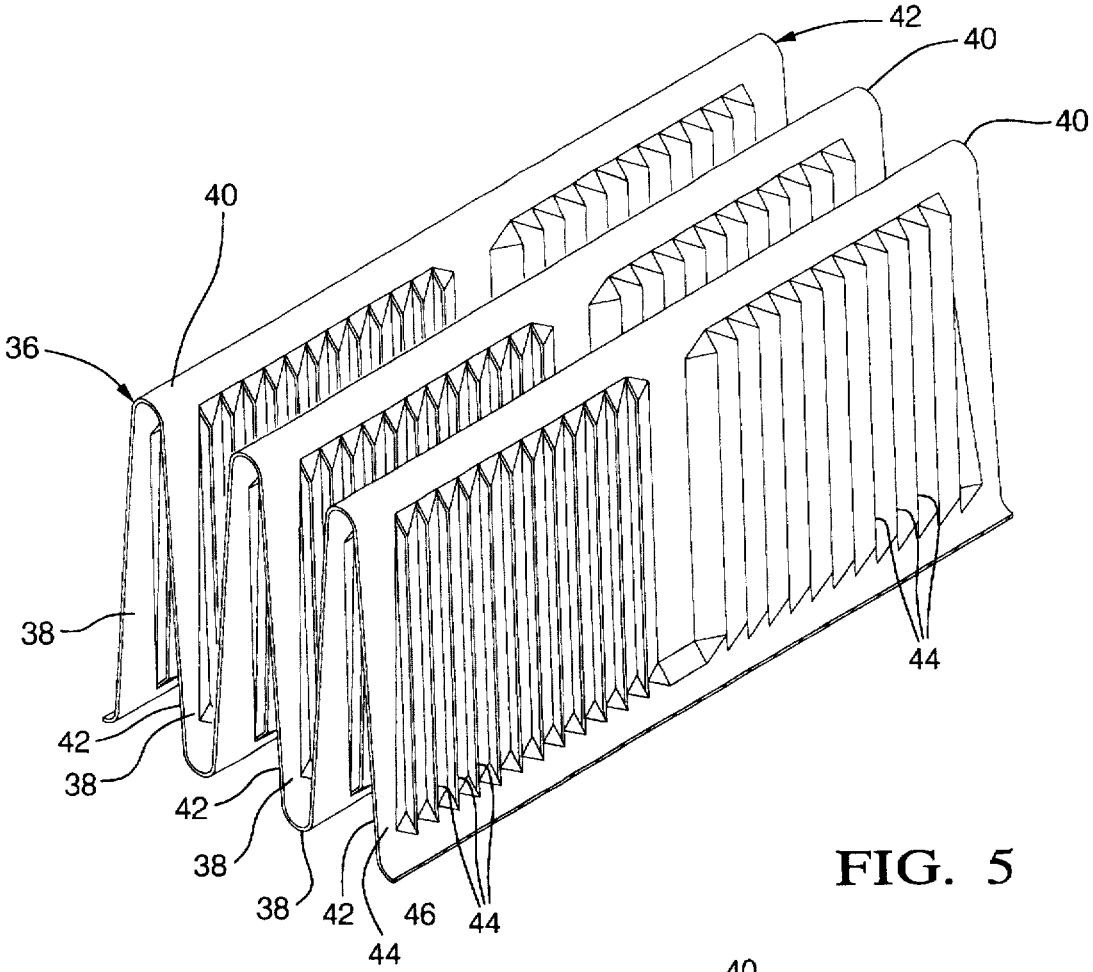
Figure 6:
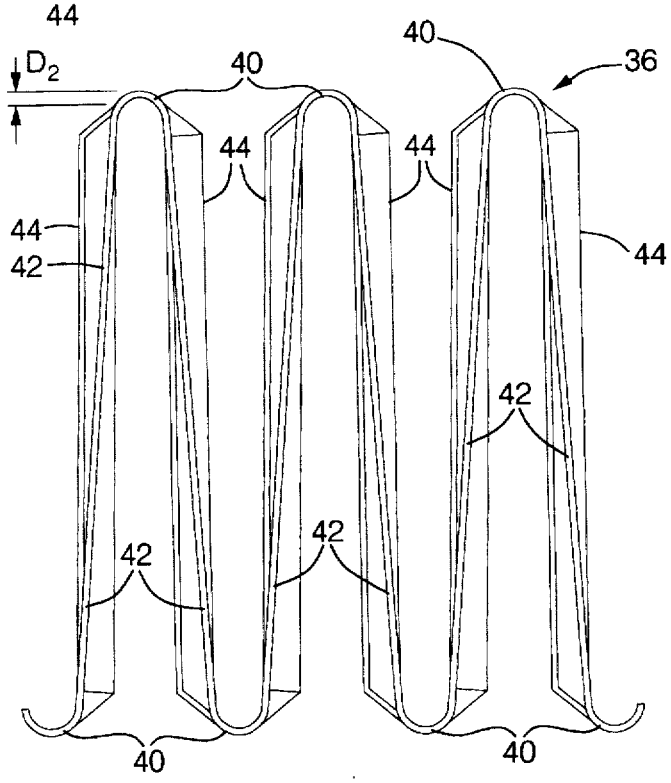
Figure 7:
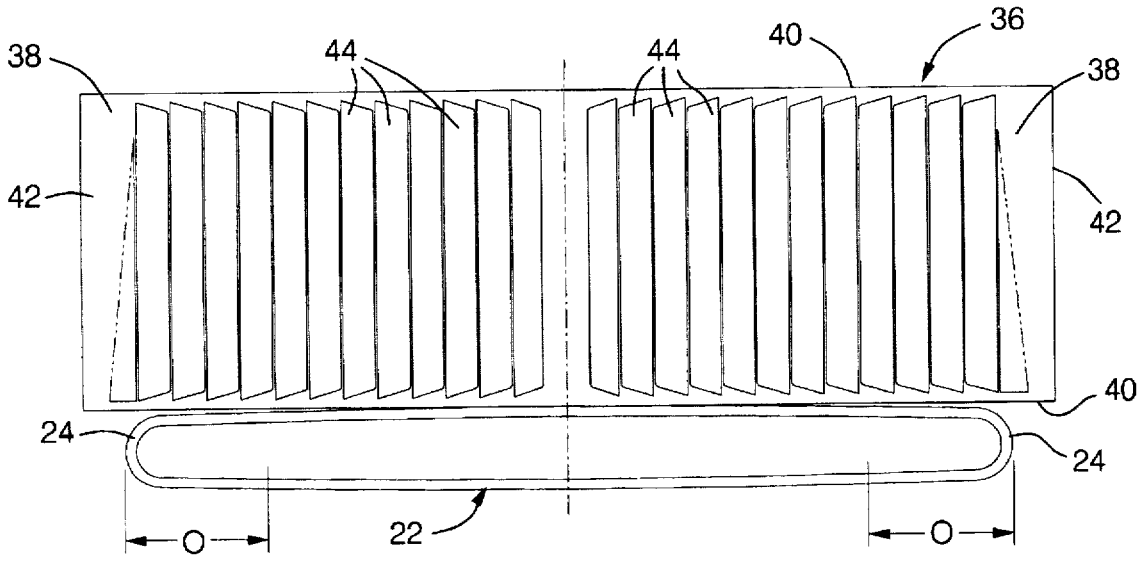
Figure 8:
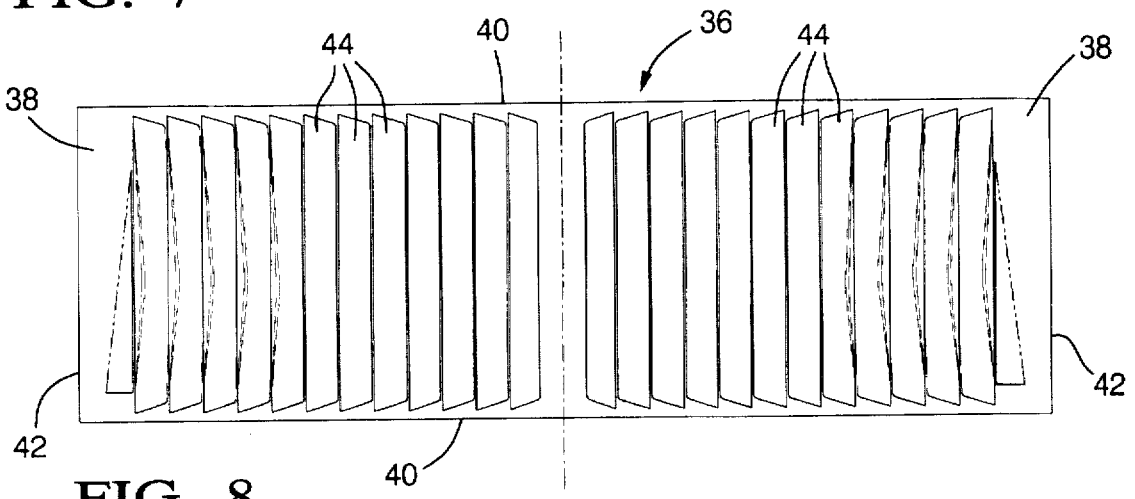
Figure 9:
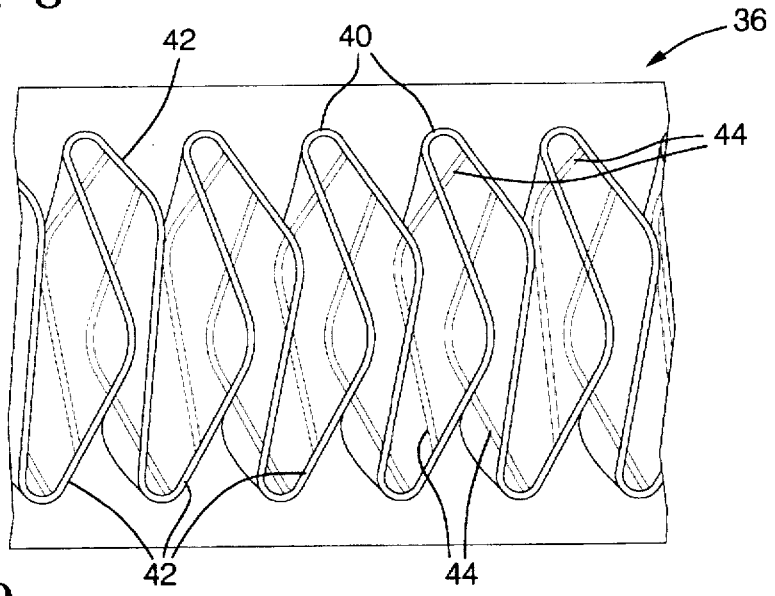
Figure 13:
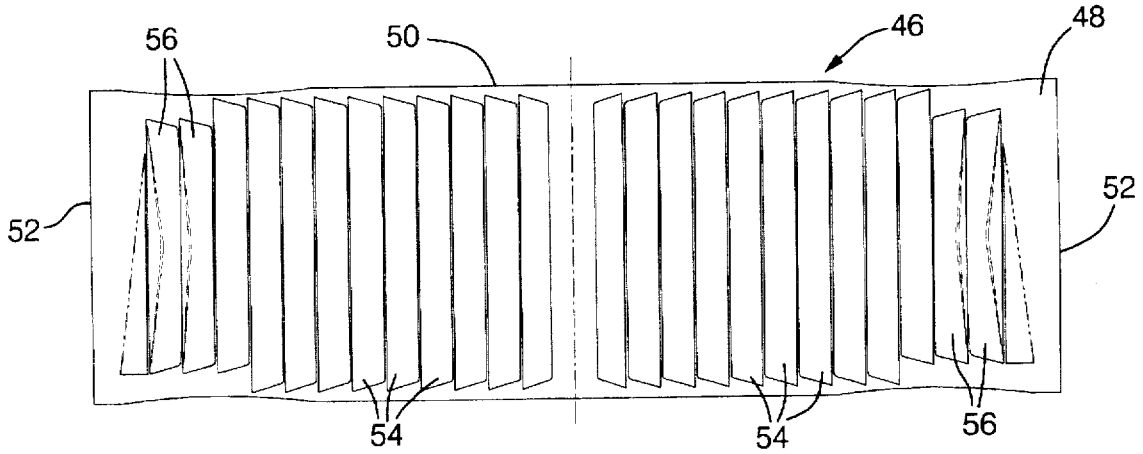
FIG. 13 is a side view of the fin as in FIG. 10, but shown after testing to the point of buckling failure.
Figure 14:
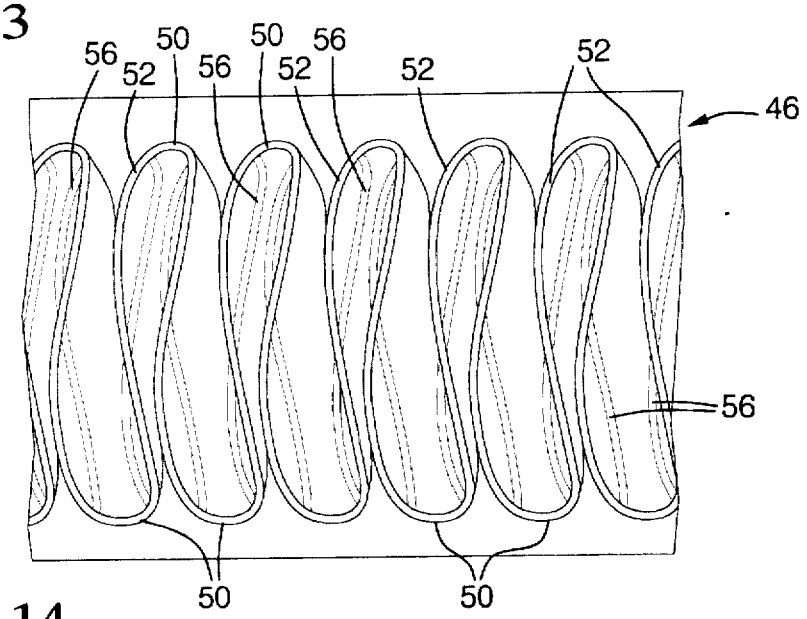
FIG. 14 is an end view of the fin in the same condition as FIG. 13.
Figure 15:
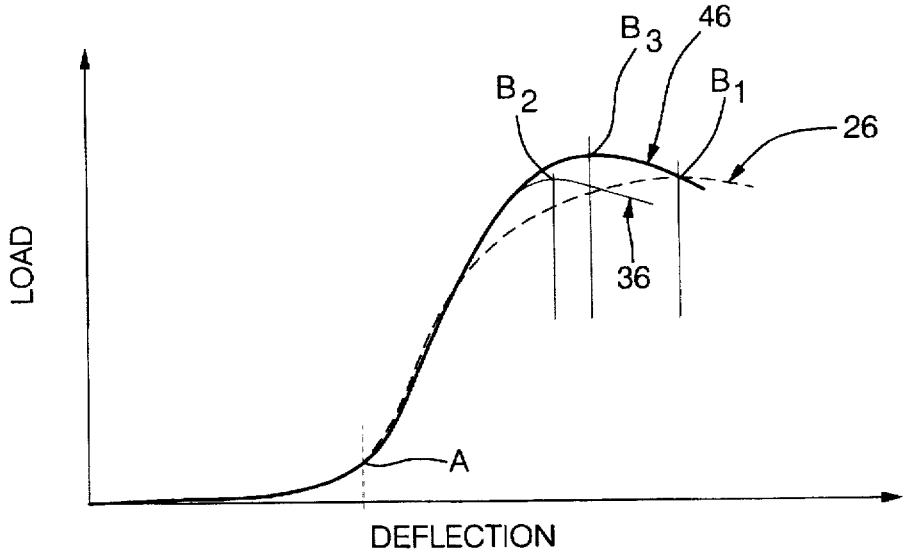
FIG. 15 is a graph illustrating the comparison among the fins 26 and 36 described above as they are tested to the point of buckling failure, and a preferred embodiment of the fin of the invention as described below.

Referring next to FIGS. 13, 14 and 15, the performance of the fin 46 of the invention is illustrated. FIGS. 13 and 14 are comparable to FIGS. 8 and 9 described below, in that they show the corresponding test performance of the fin 46 when subjected to the same over compression to the point of buckling failure. As seen in FIG. 13, buckling failure is confined substantially to the two outboard louvers 56 near each fin wall outer edge 52, and the portion of wall 48 near the outer edge 52, and does not extend back as far into the non shortened inboard louvers 54. As seen in FIG. 14, the fundamental reason for this buckling damage confinement is that the outer portion of the crests 50 was able to bow down and flatten significantly, absorbing the over compression as a spring would, effectively insulating most of the remainder of the fin walls 48 and louvers 44 from deformation. This can be compared to the same test result shown in FIG. 9, when the crests 40 remained sharp and did not flatten, and where the fin walls consequently did buckle. FIG. 15 graphically compares the performance of fins 26, 36 and 46 when subjected to the same compress to failure test. Load is shown on the vertical axis, and deflection (in the direction of compression) is shown on the horizontal axis. Up to the point A, the gaps between fins and tubes are simply closing up, so there is a good deal of movement in the direction of compression, but very little resistance to that movement and very little consequent load increase. From point A onward, the fins are solidly resisting any further decrease in the tube spacing, and the load rises rapidly and almost linearly. The load peaks at the point of buckling failure, indicated at B1, B2 and B3 for the fins 26, 36 and 46 respectively. The distance from point A to the various points B, indicated by double headed areas, correlates to the deflection listed in a table below. The old fins 26 clearly are best able to absorb deflection, and absorb the most deflection before failure. The fin 36, which performs better thermally, fails much sooner in the process. The subject fin 46 falls in between the two in terms of ability to absorb deflection and delay buckling, but is significantly better performing that fin 36. Furthermore, fin 46 performs substantially as well thermally as fin 36, so that it is preferable overall.

The table produced below compares the thermal performance of the fins 26, 36 and 46, as well as showing their relative performance when tested to buckling failure in the manner described above. Fins in a completed core were tested for heat transfer and air pressure drop, at an air flow speed of 8 m/sec and with a coolant flow through the tubes of 100 L/minute.

| | Thermal Performance | | Crush Strength | |
|---|---|---|---|---|
| Fin Design | heat trans | delta P | load (N) | Deflection (mm) |
| 26 | baseline | baseline | 630 | 130.5 |
| 36 | +8.1% | +48.5% | 555.5 | 74.1 |
| 46 | +7.0% | +38.2% | 652.9 | 87.6 |

The heat transfer capability of the conventional fin 26, with standard length louvers 34, is treated as the baseline to which the others are compared. Fin 26 clearly is the most tolerant of crush, deflecting the most under compression and reaching a relatively high load before failing. Fin 36, with all louvers 44 lengthened as compared to fin 26, has a significantly worse crush performance as compared to fin 26, but with a better heat transfer, albeit coupled with a significantly increased air pressure drop. Still, in terms of overall thermal performance, including both the desirable heat transfer improvement and the otherwise undesirable pressure drop increase, fin 36 would still be preferred to fin 26 but for its poorer crush resistance. Fin 46 made according to the invention, with the shorter (as compared to the louvers 44 or fin 36) outboard louvers 56, has a slightly less improved heat transfer than fin 36, as compared to fin 26. This is to be expected, because increasing the louver length improves heat transfer, and shortening even a few louvers would be expected to lower heat transfer somewhat. However, fin 46 also had a significantly less increased pressure drop than fin 36. The reason for this is not perfectly understood, but is thought to be a result of the shorter outboard louvers 56 near the outboard edges being less resistant to air flow entering and exiting the core. In any event, fin 46 would be considered essentially the equivalent of fin 36 in overall thermal performance. Fin 46 is significantly better than fin 36 in crush resistance, however, reaching a much higher load and deflection before failure. Therefore, fin 46 is preferable to fin 36 considering overall performance, both in operation and crush resistance during assembly.

Variations of the preferred embodiment of fin 46 as disclosed could be made. For example, in conventional fin designs like fin 26 described above, the louvers 34 are bent out of the fin wall 28, to either side thereof, along axes that are parallel to the width of the fin wall 28, and perpendicular to the crests 30. This limits the length of the louvers 34 since, at some point, they will begin to contact one another just inside of the crests 30. The fins 36 and 46 both are made according to a newer method which avoids that louver length limitation, by bending the louvers about skewed axes, allowing the louver length to reach essentially an absolute maximum, as a percentage of fin wall width. Even with fins like 26 in which the louver length is taken to the lesser maximum length allowed by the design limitation described, strategically shortening the most outboard few of the louvers would increase the buckling resistance of the fin. Increased crush resistance is most needed in a fin like 36, however. As disclosed, the shorter fins 56 are themselves equal in length. However, they could be progressively shortened, moving in a direction toward the fin wall outer edges. More than two outboard louvers could be shortened in this progressive fashion, so as to match the increasing stiffness of the tube itself moving toward the tube outer edges. In a tube with a center stiffening rib located midway between the two outer edges, a central portion of the length of the fin crests would also cross a region of increased tube stiffness, and also be subject to buckling. In that case, a selected few of those louvers near the center of the fin walls could be shortened, as well, so as to compensate for the increased tube stiffness at the center. Therefore, it will be understood that it is not intended to limit the invention to the single embodiment disclosed.

We claim:

1. A heat exchanger core (20) having a plurality of pairs of parallel, substantially flat and elongated tubes (22) of predetermined width having a predetermined tube to tube spacing, said tubes having regions of increased stiffness (24) defined along the length thereof, said heat exchanger core (20) also having a corrugated heat exchanger fin (36) located between each pair of tubes (22), said fins (36) each comprising a series of substantially flat walls (38) integrally folded at alternating crests (40), said (40) crests having a length measured between outer edges (42) of said fin walls (38) that is substantially equal to said tube width and oriented substantially perpendicular to the length of said tubes (22) so as to cross said defined regions of increased tube stiffness (24), said fin walls (38) having a predetermined width measured between adjacent crests (40) and along said walls (38), said fin (36) having a predetermined height that is slightly greater than said predetermined tube spacing so as to assure compressed contact between said fin crests (40) and said tubes (22) when said tubes (22) are stacked to said predetermined spacing with said fins (36) contained between said pairs of tubes (22), characterized in that, each fin wall (36) has a series of integral, substantially planar louvers (44, 46) bent out of said wall and spaced along the length of said fin wall crests (40), said louvers (44, 46) having an end to end length generally parallel to said fin wall width and comprising a substantial portion of said fin wall width, thereby stiffening said fin crests (40), a number of said louvers (46) closest to where said fin crests (40) cross said regions of increased tube stiffness (24) being shortened relative to the remaining louvers (44) so as to leave corresponding portions of the length of said fin crests (40) relatively more flexible, whereby, when said fins (36) are stacked and compressed between said pairs of tubes (22), the more flexible portions of said fin crests (40) are aligned with and compressed between the regions of increased tube stiffness (24), thereby substantially preventing the buckling of said fin walls (36) and louvers (44, 46).

2. A heat exchanger core (20) according to claim 1, further characterized in that said tube regions of increased stiffness comprise outer edges (24) of said tubes (22), and said shortened louvers (46) are outboard louvers located near the outer edges (42) of said fin walls (38).

3. A heat exchanger core (20) according to claim 2, further characterized in that said crest (30) length is slightly longer than said tube (22) width.

* * * * *